US008216089B2

(12) United States Patent
Matsunaga et al.

(10) Patent No.: US 8,216,089 B2
(45) **Date of Patent: *Jul. 10, 2012**

(54) GOLF CLUB HEAD

(75) Inventors: Hideo Matsunaga, Chichibu (JP); Makoto Kubota, Tokyo (JP); Masaomi Hiruta, Tokyo (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/847,128

(22) Filed: Jul. 30, 2010

(65) Prior Publication Data

US 2010/0292023 A1 Nov. 18, 2010

Related U.S. Application Data

(63) Continuation of application No. 12/174,138, filed on Jul. 16, 2008, now Pat. No. 7,819,758.

(30) Foreign Application Priority Data

Mar. 26, 2008 (JP) ..... 2008-080680

(51) Int. Cl.
*A63B 53/04* (2006.01)

(52) U.S. Cl. ..... 473/342; 473/345

(58) Field of Classification Search ..... 473/324–350
See application file for complete search history.

(56) References Cited

U.S. PATENT DOCUMENTS

| | | | | |
|---|---|---|---|---|
| 4,432,549 | A | 2/1984 | Zebelean | |
| 5,755,627 | A | 5/1998 | Yamazaki et al. | |
| 6,381,828 | B1 | 5/2002 | Boyce et al. | |
| 6,491,592 | B2 | 12/2002 | Cackett et al. | |
| 6,506,129 | B2 | 1/2003 | Chen | |
| 6,663,501 | B2 | 12/2003 | Chen | |
| 6,783,466 | B2 | 8/2004 | Seki et al. | |
| 6,835,145 | B2 | 12/2004 | Tsurumaki | |
| 6,949,031 | B2 | 9/2005 | Imamoto | |
| 7,096,558 | B2 | 8/2006 | Sano | |
| 7,121,958 | B2 * | 10/2006 | Cheng et al. | 473/345 |
| 7,147,576 | B2 | 12/2006 | Imamoto et al. | |
| 7,153,221 | B2 | 12/2006 | Hocknell et al. | |
| 7,156,750 | B2 | 1/2007 | Nishitani et al. | |
| 7,169,059 | B2 | 1/2007 | Rice et al. | |
| 7,198,575 | B2 | 4/2007 | Beach et al. | |
| 7,344,452 | B2 | 3/2008 | Imamoto et al. | |
| 7,347,795 | B2 | 3/2008 | Yamagishi et al. | |
| 7,575,525 | B2 | 8/2009 | Matsunaga et al. | |
| 7,686,706 | B2 * | 3/2010 | Matsunaga et al. | 473/329 |
| 7,819,758 | B2 * | 10/2010 | Matsunaga et al. | 473/345 |
| 2008/0153628 | A1 | 6/2008 | Makino et al. | |

FOREIGN PATENT DOCUMENTS

| | | | |
|---|---|---|---|
| JP | 01-068285 | A | 3/1989 |
| JP | 08-155060 | A | 6/1993 |
| JP | 06031421 | A | 2/1994 |
| JP | 08-266690 | A | 10/1996 |
| JP | 9-154985 | A | 6/1997 |

(Continued)

*Primary Examiner* — Alvin Hunter

(74) *Attorney, Agent, or Firm* — Sughrue Mion, PLLC

(57) ABSTRACT

This invention provides a golf club head including a face member. The face member includes a face portion forming a face, and a crown extending portion extending backward from the upper edge of the face portion. The width of the crown extending portion in a face to back direction at the toe side is larger than that in the face to back direction at the heel side.

15 Claims, 4 Drawing Sheets

FOREIGN PATENT DOCUMENTS

| | | | |
|---|---|---|---|
| JP | 11-313906 | A | 11/1999 |
| JP | 2000-350798 | A | 12/2000 |
| JP | 2001-062004 | A | 3/2001 |
| JP | 2001-137396 | A | 5/2001 |
| JP | 2002-085601 | A | 3/2002 |
| JP | 2002-119625 | A | 4/2002 |
| JP | 3089327 | U | 10/2002 |
| JP | 2003-52866 | A | 2/2003 |
| JP | 2003-126311 | A | 5/2003 |
| JP | 2003-230643 | A | 8/2003 |
| JP | 2003-265656 | A | 9/2003 |
| JP | 2004-16654 | A | 1/2004 |
| JP | 2004-024438 | A | 1/2004 |
| JP | 2004-65660 | A | 3/2004 |
| JP | 2004-222792 | A | 8/2004 |
| JP | 2004-229820 | A | 8/2004 |
| JP | 2004-357978 | A | 12/2004 |
| JP | 2005-6698 | A | 1/2005 |
| JP | 2005-6835 | A | 1/2005 |
| JP | 2005-6836 | A | 1/2005 |
| JP | 2007-054565 | A | 3/2007 |
| JP | 2007-216062 | A | 8/2007 |
| JP | 2008-154624 | A | 7/2008 |

* cited by examiner

GOLF CLUB HEAD

This is a continuation of application Ser. No. 12/174,138, filed Jul. 16, 2008. The entire disclosure of the prior application, application Ser. No. 12/174,138, is hereby incorporated by reference.

BACKGROUND OF THE INVENTION

1. Field of the Invention

The present invention relates to a hollow golf club head.

2. Description of the Related Art

Conventionally, a golf club head which includes a face member having an extending portion that extends backward from a face portion forming the face has been proposed (Japanese Patent Laid-Open No. 2005-6698). This golf club head is designed to increase the distance of a shot by the above-described extending portion.

SUMMARY OF THE INVENTION

The present invention has as its object to provide a golf club head with which the traveling distance can hardly be reduced even when hitting a golf ball off the sweet spot.

According to the present invention, there is provided a golf club head comprising a face member, wherein the face member comprises: a face portion forming a face; and a crown extending portion extending backward from an upper edge of the face portion, and a width of the crown extending portion in a face to back direction at a toe side is larger than a width of the crown extending portion in the face to back direction at a heel side.

Further features of the present invention will become apparent from the following description of exemplary embodiments (with reference to the attached drawings).

DESCRIPTION OF THE EMBODIMENTS

Figure 1:
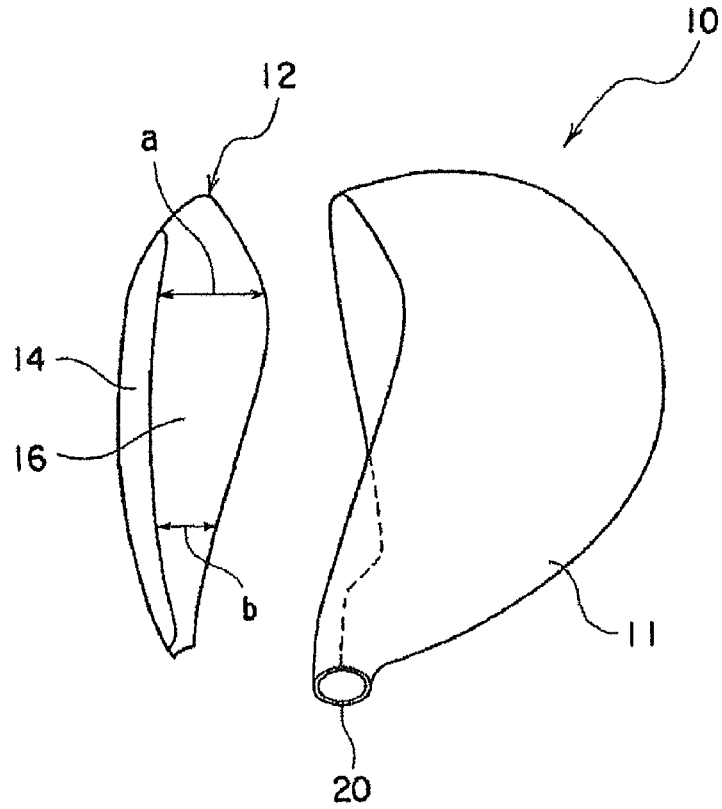
FIG. 1 is an exploded plan view showing a metal golf club head according to an embodiment of the present invention.

FIG. 1 is an exploded plan view showing a metal golf club head 10 according to an embodiment of the present invention. The metal golf club head 10 is a hollow body comprising two members, i.e., a head main body member 11 and a face member 12. The face member 12 includes a face portion 14 that forms the face and a crown extending portion 16 that extends backward from the upper edge of the face portion 14 and forms a part of the crown portion of the golf club head 10. In the crown extending portion 16, a width a in the face to back direction at the toe side is larger than a width b in the face to back direction at the heel side.

Figure 2:
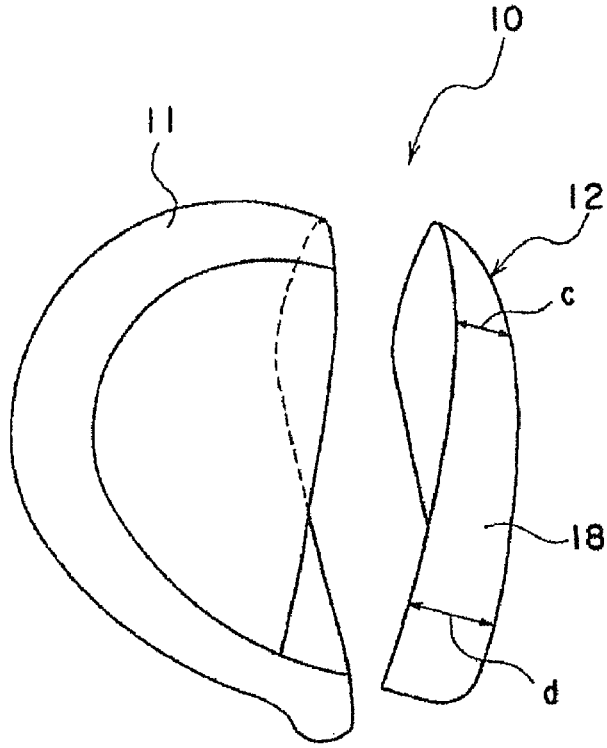
FIG. 2 is an exploded bottom view of the golf club head in FIG. 1.

As shown in FIG. 2, the face member 12 includes a sole extending portion 18 that extends backward from the lower edge of the face portion 14 and forms a part of the sole portion of the golf club head 10. In the sole extending portion 18, a width c in the face to back direction at toe side is smaller than a width d in the face to back direction at the heel side.

The maximum width (to be also referred to as the width in the face to back direction, hereinafter) of the crown extending portion 16 at the toe side is preferably 8 mm to 35 mm, and particularly preferably 10 mm to 20 mm. The maximum width of the crown extending portion 16 at the heel side is preferably 2 mm to 15 mm, and particularly preferably 3 mm to 8 mm. The maximum width of the sole extending portion 18 at the toe side is preferably 2 mm to 15 mm, and particularly preferably 3 mm to 8 mm. The maximum width of the sole extending portion 18 at the heel side is preferably 8 mm to 20 mm, and particularly preferably 10 mm to 15 mm. The ratio of the maximum width of the crown extending portion 16 at the toe side to the maximum width of the crown extending portion at the heel side is preferably set to 1:0.2 to 0.6, and particularly preferably set to 1:0.3 to 0.5. The ratio of the maximum width of the sole extending portion 18 at the heel side to the maximum width of the sole extending portion at the toe side is preferably set to 1:0.2 to 0.6, and particularly preferably set to 1:0.3 to 0.5. Note that when a hosel portion 20 is connected to the head main body member 11 as in this embodiment, no crown extending portion 16 may be provided in a joint position of the hosel portion 20 and face member 12.

A position where the width of the crown extending portion 16 is largest is away from the center of gravity position of the golf club head 10 projected onto the face by preferably 15 mm or more, and more preferably 20 mm or more toward the toe side.

The wall thickness of the face portion 14 of the face member 12 is preferably in a range of 1.5 mm to 3.5 mm for a stainless alloy, maraging steel, a titanium alloy, and a copper alloy, and preferably in a range of 5 mm to 10 mm for an aluminum alloy and magnesium alloy. The crown extending portion 16 of the face member 12 is preferably formed thinner than the face portion 12, and its minimum thickness is preferably 0.5 mm to 1.5 mm. The minimum thickness of the crown extending portion 16 is preferably 1 mm to 2 mm for an aluminum alloy and magnesium alloy.

The thickness of the sole extending portion 18 may be equal to or larger than that of the crown extending portion 16. Decreasing the thickness of the crown extending portion 16 has an effect of increasing a launch angle. Forming the sole extending portion 18 thicker than the crown extending portion 16 is effective for lowering the center of gravity or enforcing join of the head main body and face member 12.

In this embodiment, the shape of the crown portion is an arch (arcuate) shape from the face side toward the back side. In contrast, the shape of the sole portion is straight from the face side toward the back side. Since the face has a loft angle, the face portion and sole portion form an acute angle while including a chamfered portion. Accordingly, in order to enforce joint of the head main body member 11 and face member 12, the thickness of the sole extending portion 18 may be increased.

Preferably, the thickness of the crown extending portion 16 at the toe side is smaller than that at the heel side. With this arrangement, an effect of obtaining good repulsion even when hitting a ball at the upper portion of the face at the toe side can be attained. More specifically, the thickness of the crown extending portion 16 at the toe side is preferably 0.5 mm to 1.2 mm, and particularly preferably 0.6 mm to 0.9 mm. Also, the thickness of the crown extending portion 16 at the heel side is preferably 0.8 mm to 1.5 mm, and particularly preferably 0.9 mm to 1.3 mm. In the above-described range, the thickness of the crown extending portion 16 at the heel side is formed larger than that at the toe side.

Preferably, the thickness of the sole extending portion 18 at the toe side is larger than that at the heel side. With this arrangement, an effect of obtaining good repulsion even when hitting a ball at the lower portion of the face at the heel side can be attained. More specifically, the thickness of the sole extending portion 18 at the toe side is preferably 0.8 mm to 1.2 mm, and particularly preferably 0.9 mm to 1.5 mm. Also, the thickness of the sole extending portion 18 at the heel side is preferably 0.5 mm to 1.2 mm, and particularly preferably 0.6 mm to 1.0 mm. In the above-described range, the thickness of the sole extending portion 18 at the heel side is formed larger than that at the toe side.

In this embodiment, the width of the crown extending portion 16 of the face member 12 is increased at the toe side. With this arrangement, the same effect as in a case in which the vertical width (to be also referred to as the width in the crown to sole direction, hereinafter) of the face at the toe side is increased is produced. Since the width of the crown extending portion 16 is increased at the toe side, particularly, an effect of improving the repulsion of a ball upon hitting the ball at the upper portion of the face at the toe side can be attained. That is, since not only flexure of the face portion 14 but also flexure of the crown extending portion 16 is utilized, a repulsion force with respect to a ball does not decrease even when hitting the ball off the sweet spot, and therefore the difference in a traveling distance between hitting a ball at and off the sweet spot becomes small.

In addition, when the sole extending portion 18 is provided in the face member 12 and the width of the sole extending portion 18 is increased at the heel side, substantially, the same effect as in a case in which the vertical width of the face at the heel side is increased is produced. Since the width of the sole extending portion 18 is increased at the heel side, particularly, an effect of improving the repulsion of a ball upon hitting the ball at the lower portion of the face portion 14 at the heel side can be attained. Accordingly, it is possible to effectively prevent a decrease in the traveling distance upon hitting a golf ball off the sweet spot.

In a general wood golf club head, the vertical width of the face is smaller than the lateral width (to be also referred to as the length in the toe to heel direction, hereinafter). The vertical width of the face decreases from the face center position toward the toe and heel sides. Since the vertical width of the face is smaller than the lateral width of the face, it is considered that the vertical width of the face greatly influences a repulsion force with respect to a ball. As described above, when the vertical width of the face is substantially increased, it is possible to obtain the repulsion (traveling distance) of a ball close to that obtained when hitting the ball at the sweet spot (the position almost the same as the face center) even when hitting the ball off the sweet spot.

In this embodiment, a thick-walled portion 22 which protrudes can be formed in the center of the backside of the face portion 14 of the face member 12 in the toe to heel direction. This thick-walled portion 22 is formed between the crown side and sole side of the backside of the face portion 14 such that it includes a position (sweet spot) corresponding to the center of gravity position of the golf club head 10 projected onto the face. Furthermore, the thick-walled portion 22 preferably includes the face center.

Figure 3:
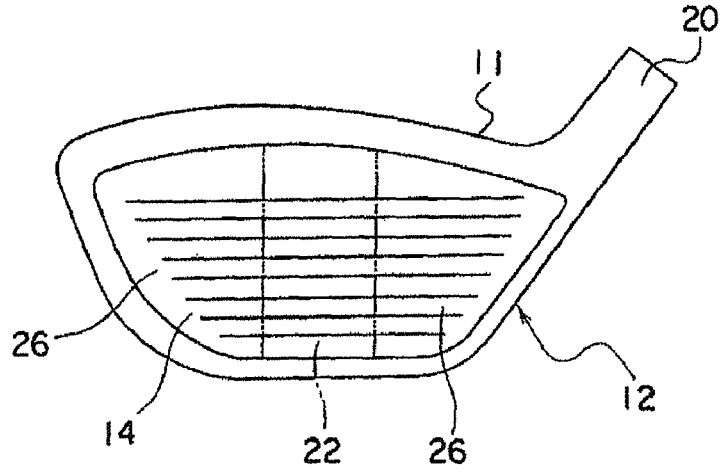
FIG. 3 is a front view showing a golf club head according to an embodiment of the present invention.
Figure 5:
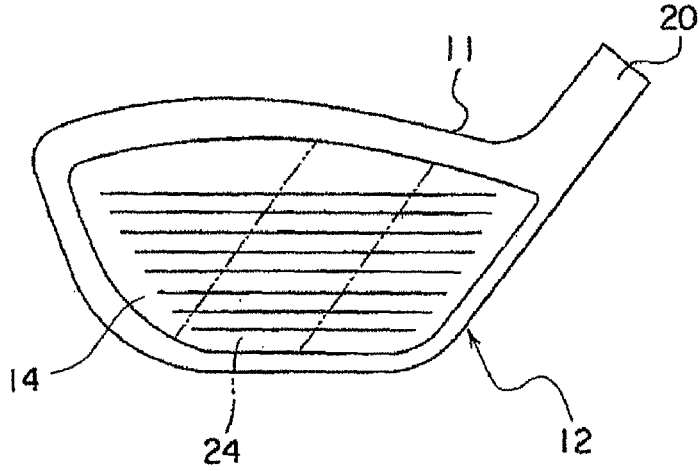
FIG. 5 is a front view showing a golf club head according to an embodiment of the present invention.

The width of the thick-walled portion 22 in the toe to heel direction is preferably 20 mm to 45 mm, and particularly preferably 25 mm to 35 mm. Such a thick-walled portion can be vertical when viewed from the front of the face, like the thick-walled portion 22 shown in FIG. 3, or may be formed such that it inclines from the toe side of the sole portion to the heel side of the crown portion when viewed from the front of the face, like a thick-walled portion 24 shown in FIG. 5. This is because the hitting points of golf balls vary in an almost ellipse having a major axis extending from the toe side of the crown side to the heel side of the sole side on the face. Accordingly, when the face portion 14 is decreased in thickness at the toe side of the crown side and the heel side of the sole side, the rigidities of the above-described portions of the face can be lower than that of the face center position or a position (sweet spot) corresponding to the center of gravity position projected onto the face. With this arrangement, a high repulsion of a ball can be obtained even when hitting the ball off the center, and therefore the traveling distance close to that obtained when hitting the ball at the sweet spot can be obtained.

Figure 6:
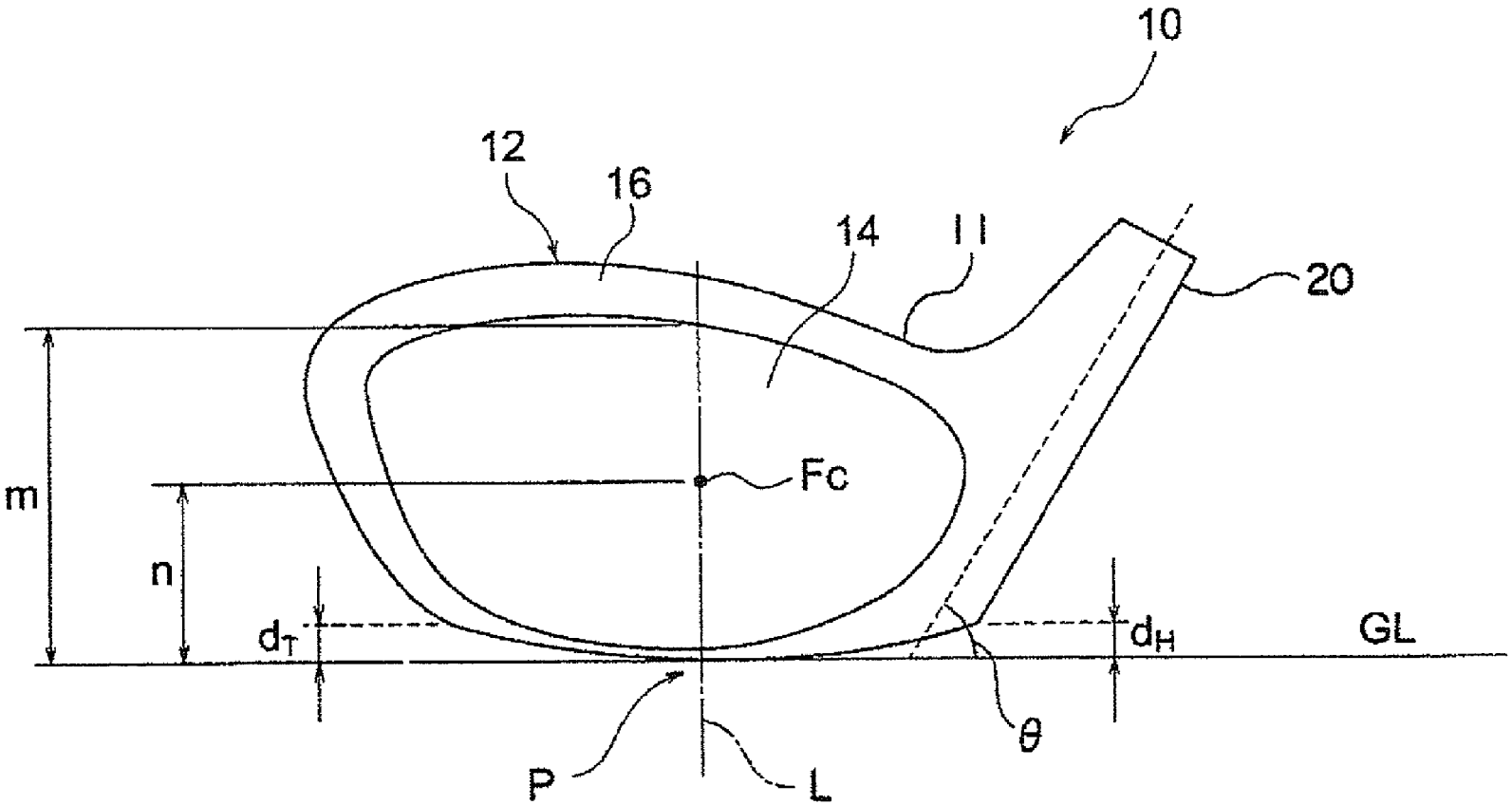
FIG. 6 is a view for explaining the method of determining the face center of a golf club head.
Figure 7:
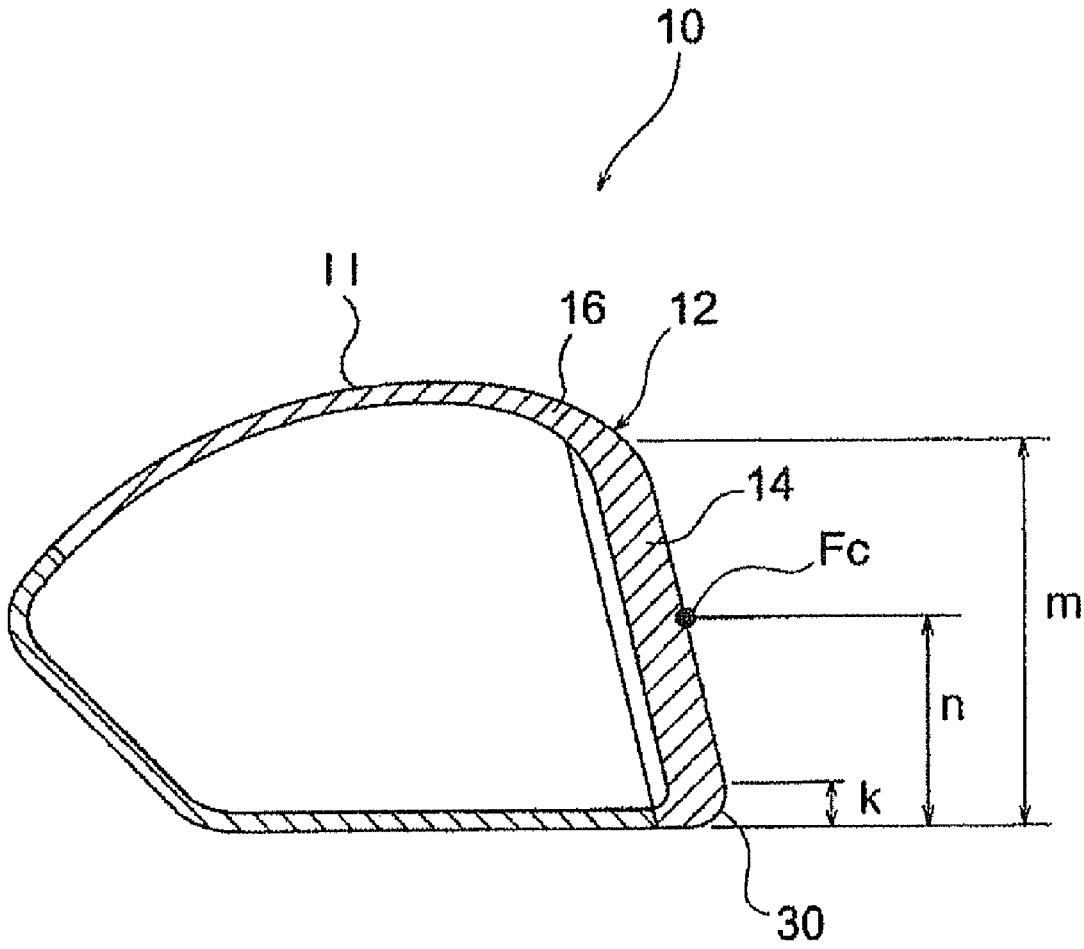
FIG. 7 is a view for explaining the method of determining the face center of a golf club head.

The above-described face center is determined as follows. As shown in FIG. 6, a head is set such that gaps dT and dH at the two ends of the sole at the toe and heel sides become equal. An angle θ at this time is a lie angle. A general lie angle of No. 1 wood club is 56°. Then, assume that a contact point P of the sole and a ground line (GL) is a face center position L in the toe to heel direction, and a slice angle is set to 0°. As shown in FIGS. 6 and 7, the position of a face center (Fc) is determined by obtaining a height n of the face center (Fc) in the crown to sole direction at the face center position L in the toe to heel direction in accordance with a height m of the face portion 14 in the crown to sole direction at the face center position L in the toe to heel direction and a height k of a chamfered portion 30, which is at the lower edge of the face portion 14, in the crown to sole direction at the face center position L, using:

$$n=\{(m-k)/2\}+k \quad (1)$$

where n: the height of the face center (Fc) in the crown to sole direction at the position L m: the height of the face portion in the crown to sole direction at the position L k: the height of the chamfered portion in the crown to sole direction at the position L In the relationship between the face portion 14 and crown extending portion 16 or sole extending portion 18, the radius of curvature (R1) of a curve from the frontside of the face portion 14 to the frontside of the crown extending portion 16 is preferably smaller than the radius of curvature (R2) of a curve from the backside of the face portion 14 to the backside of the crown extending portion 16. In addition, the radius of curvature (R3) of a curve from the frontside of the face portion 14 to the frontside of the sole extending portion 18 is preferably smaller than the radius of curvature (R4) of a curve from the backside of the face portion 14 to the backside of the sole extending portion 18. With this arrangement, the thickness of a portion which extends from the face portion 14 to the crown extending portion 16 or sole extending portion 18 can be increased, and therefore the head strength upon hitting a ball at the corner of the face portion 14 can be increased.

Figure 4:
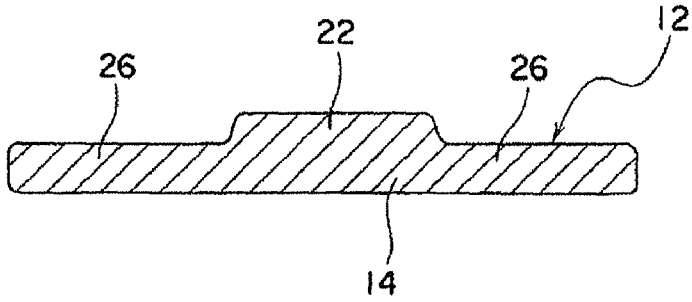
FIG. 4 is a sectional view showing the face member of the golf club head in FIG. 2.

In addition, the radius of curvature (R5) of a curve from the backside of the face portion 14 to the backside of the crown extending portion 16 in the thick-walled portion 22 of the face portion 14 is preferably smaller than the radius of curvature (R6) of a curve from the backside of the face portion 14 to the backside of the crown extending portion 16 in a thin-walled portion 26 (see FIGS. 3 and 4) at each side of the thick-walled portion 22. In addition, the radius of curvature (R7) of a curve from the backside of the face portion 14 to the backside of the sole extending portion 18 in the thick-walled portion 22 of the face portion 14 is preferably smaller than the radius of curvature (R8) of a curve from the backside of the face portion 14 to the backside of the sole extending portion 18 in the thin-walled portion 26 at each side of the thick-walled portion 22. With this arrangement, the thickness of a portion in each thin-walled portion 26 that extends from the face portion 14 to the crown extending portion 16 or sole extending portion 18 can be increased, and therefore the corner portions of the thin-walled portions 26 can be strengthened.

As a metal material used for the golf club head of the present invention, for example, a metal material that mainly uses one selected from a magnesium alloy, an aluminum alloy, a stainless alloy, maraging steel, a titanium alloy, and a copper alloy is available. "Mainly use" means that a metal or alloy such as a tungsten alloy or lead having a higher specific gravity (preferably a specific gravity of 8 or more, and more preferably a specific gravity of 10 or more) than a material used for a head main body may be used as a weight member, or a material, e.g., a viscoelastic body such as an elastomer or rubber or a resin, having lower Young's modulus than a metal may be used for a portion of the head main body so as to attenuate vibration of the head.

Of the above-described metal materials, a material such as a titanium alloy, aluminum alloy, or the like having a low specific gravity is preferable because it can increase a head volume as well as the area of the face portion. Particularly, a titanium alloy having high strength and low Young's modulus is preferable.

In the face member 14 and head main body member 11, it is also possible to form the sole portion using a metal and form the remaining portion of the head main body member 11 using a fiber reinforced resin. Note that since a fiber reinforced resin has lower Young's modulus than a general metal material, the above-described effect decreases.

The face member 12 can be formed by a proper method such as forging, press molding, casting, or the like. Formation by forging is preferable in terms of strength since structural defects decrease and fine metal particles are obtained micro. Formation by casting facilitates formation of a complicated shape, as well as formation of the crown extending portion 16 over the top of the crown portion. Generally, press molding is a method of pressing a plate having a uniform thickness and heat-treating the molded plate. A material such as a β-type titanium alloy can be molded. Press molding can perform molding easily, but it is not suitable for forming a variety of thick-walled portions. However, by using an acid cleaning method, a portion not to be dissolved is covered with a mask, the mask on a portion to be decreased in thickness is partially removed, and then the material is dipped in a chemical reaction solution to dissolve the exposed portion, so as to decrease the wall thickness.

EXAMPLES

Golf club heads of Examples 1 and 2 were fabricated, and a test to compare them with a golf club head of a comparative example was performed. The golf club head (No. 1 wood) of Example 1 had the same arrangement as the golf club head 10 shown in FIGS. 1 and 2. A titanium alloy (Ti-6Al-4V) was used as the material of a head main body member and face member, and a screw made of a tungsten alloy was provided in a sole portion at the back side to adjust the head weight. The head main body member and face member were formed by casting using investment casting. In the face member, the thickness of a face portion is uniformly 3.0 mm, the thickness of a crown extending portion near a head main body join portion is 0.6 mm at the toe side and 0.8 mm at the heel side, the thickness of a sole extending portion near the head main body join portion is 1.5 mm at the toe side and 1.2 mm at the heel side, the maximum width of the crown extending portion at the toe side is 15 mm and the minimum width at the heel side is 3.0 mm, and the minimum width of the sole extending portion at the toe side is 2 mm and the maximum width at the heel side is 10 mm.

The golf club head (No. 1 wood) of Example 2 also had the same arrangement as the golf club head 10 shown in FIGS. 1 and 2. A titanium alloy (Ti-6Al-4V) was used as the material of a head main body member and face member, and a screw made of a tungsten alloy was provided in a sole portion at the back side to adjust the head weight. The thickness of a face portion of the face member is 3.5 mm at a face center portion and 2.5 mm at the toe and heel sides. The thickness of a crown extending portion near a head main body join portion is 0.7 mm at the toe side and 0.95 mm at the heel side. The thickness of a sole extending portion near the head main body join portion is 1.4 mm at the toe side and 0.8 mm at the heel side. The maximum width of the crown extending portion at the toe side is 15 mm, and the minimum width at the heel side is 3 mm. The minimum width of the sole extending portion at the toe side is 2 mm, and the maximum width at the heel side is 10 mm.

The golf club head (No. 1 wood) of the comparative example had a head main body member which was made of a titanium alloy (Ti-6Al-4V) and cast to have an opening in a sole portion, and a sole member made of a titanium alloy (Ti-6Al-4V) and welded to the opening. The thickness of a face portion was 3.0 mm, the thickness of a crown portion was 0.55 mm at the toe side and 0.75 mm at the heel side, the thickness of the sole portion was 1.0 mm at the toe side and 0.75 mm at the heel side, a head volume was 450 cm3, and a head weight was 193 g.

Each of three golfers A, B, and C hit a golf ball ten times with each of golf clubs respectively mounted with the golf club heads of the examples and comparative example. The distance of each shot was measured, and impressions about each club were also asked. The distances of shots are shown in Tables 1 to 4.

TABLE 1

Golfer: A
Head speed: 42.5 m/s

Unit: m

| Number of Times | Comparative Example | Example 1 | Example 2 |
|---|---|---|---|
| 1 | 207.5 | 209.2 | 211.9 |
| 2 | 202.8 | 208.7 | 207.8 |
| 3 | 210.2 | 213.3 | 211.8 |
| 4 | 207.6 | 210.1 | 215.2 |
| 5 | 208.4 | 208.2 | 209.8 |
| 6 | 202.1 | 209.9 | 212.4 |
| 7 | 206.4 | 210.5 | 213.4 |
| 8 | 205.4 | 206.9 | 208.9 |
| 9 | 210.8 | 208.9 | 212.7 |
| 10 | 205.5 | 211.1 | 208.9 |
| Average | 206.67 | 209.68 | 211.28 |

TABLE 2

| Golfer: B<br>Head speed: 47 m/s | | | |
|---|---|---|---|
| | | | Unit: m |
| Number of Times | Comparative Example | Example 1 | Example 2 |
| 1 | 227.1 | 230.4 | 231.7 |
| 2 | 225.6 | 229.3 | 232.5 |
| 3 | 221.4 | 225.6 | 228.9 |
| 4 | 226.1 | 227.9 | 229.6 |
| 5 | 230.2 | 233.3 | 231.1 |
| 6 | 221.1 | 228.8 | 232.4 |
| 7 | 228.2 | 229.5 | 232.5 |
| 8 | 224.2 | 232.5 | 234.7 |
| 9 | 222.9 | 233.6 | 234.4 |
| 10 | 223 | 233 | 235.1 |
| Average | 224.98 | 230.39 | 232.29 |

TABLE 3

| Golfer: C<br>Head speed: 39 m/s | | | |
|---|---|---|---|
| | | | Unit: m |
| Number of Times | Comparative Example | Example 1 | Example 2 |
| 1 | 191.1 | 195.4 | 196.7 |
| 2 | 192.3 | 194.5 | 195.7 |
| 3 | 188.5 | 194.6 | 196.1 |
| 4 | 186.6 | 192.1 | 195.8 |
| 5 | 189.2 | 191.9 | 197.7 |
| 6 | 190.5 | 192.6 | 194.5 |
| 7 | 189.8 | 192.1 | 195.3 |
| 8 | 189 | 190 | 194.6 |
| 9 | 190 | 194.7 | 197 |
| 10 | 191.5 | 195.2 | 193.5 |
| Average | 189.85 | 193.31 | 195.69 |

TABLE 4

| Average Traveling Distances of Golfers A, B, and C | | | |
|---|---|---|---|
| | | | Unit: m |
| Golfer | Comparative Example | Example 1 | Example 2 |
| A | 206.67 | 209.68 | 211.28 |
| B | 224.98 | 230.39 | 232.29 |
| C | 189.85 | 193.31 | 195.69 |
| Average | 207.1667 | 211.1267 | 213.0867 |

The impression of golfer A was as follows: the comparative example was an ordinal club, Example 1 was not greatly different from the club of the comparative example, and Example 2 gave an impression that it carried a ball far away even when hitting the ball off the sweet spot. The impression of golfer B was as follows: the comparative example did not carry balls very far, Example 1 was not greatly different from the comparative example but gave an impression that it carried a ball a little farther compared to the club of the comparative example, and Example 2 gave an impression that it carried a ball farther than expected even at the time of miss shot. The impression of golfer C was as follows: the comparative example carried a ball far away when hitting the ball at the sweet spot but did not carry a ball at all in case of a miss shot, and thus it was suitable for advanced golfers, Example 1 gave an impression that the sweet area was a little longer, and Example 2 gave an impression that it carried a ball upon hitting the ball at anywhere in the face.

From the results of this text, it is ensured that when the golf club heads of the examples are used, the traveling distances can hardly decrease even when hitting golf balls off the sweet spots.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-080680, filed Mar. 26, 2008, which is hereby incorporated by reference herein in its entirety.

What is claimed is:

1. A golf club head comprising a face member, wherein said face member comprises:

a face portion forming the entire face of the golf club head;

a crown extending portion extending backward from an upper edge of said face portion;

a sole extending portion extending backward from a lower edge of said face portion; and a toe side extending portion extending backward from a toe side edge of said face portion and connecting said crown extending portion and said sole extending portion, a width of said crown extending portion in a face to back direction at the toe side is wider than a width of said crown extending portion in the face to back direction at a heel side, and a width of said sole extending portion in the face to back direction at the toe side is narrower than a width of said sole extending portion in the face to back direction at the heel side.

2. The golf club head according to claim 1, wherein said crown extending portion extends in an arcuate shape in the face to back direction.

3. The golf club head according to claim 1, wherein said golf club head is a metal golf club head.

4. The golf club head according to claim 1, wherein said golf club head comprises said face member and a head main body member.

5. The golf club head according to claim 1, wherein said crown extending portion is over the top of said crown portion.

6. The golf club head according to claim 1, wherein said face member is integrally formed and attached to a main body of the golf club head.

7. The golf club head according to claim 1, wherein the face portion is a single piece face portion.

8. The golf club head according to claim 1, wherein a thickness of the crown extending portion at the toe side is smaller than a thickness of the crown extending portion at the heel side.

9. The golf club head according to claim 1, wherein a thickness of the sole extending portion at the toe side is larger than a thickness of the sole extending portion at the heel side.

10. A golf club head comprising a face member, wherein said face member comprises:

a face portion forming the entire face of the golf club head;

a crown extending portion extending backward from an upper edge of said face portion; and a sole extending portion extending backward from a lower edge of said face portion, a width of said crown extending portion in a face to back direction at a toe side is wider than a width of said crown extending portion in the face to back direction at a heel side, a width of said sole extending portion in the face to back direction at the toe side is narrower than a width of said sole extending portion in the face to back direction at the heel side, and a thickwalled portion convexly expands and is formed in a center of a backside of said face portion in a toe to heel direction.

11. The golf club head according to claim 10, wherein said thick-walled portion extends from a crown side at the heel side to a sole side at the toe side.

12. The golf club head according to claim 10, wherein said face member is integrally formed and attached to a main body of the golf club head.

13. The golf club head according to claim 10, wherein the face portion is a single piece face portion.

14. The golf club head according to claim 10, wherein a thickness of the crown extending portion at the toe side is smaller than a thickness of the crown extending portion at the heel side.

15. The golf club head according to claim 10, wherein a thickness of the sole extending portion at the toe side is larger than a thickness of the sole extending portion at the heel side.

* * * * *